United States Patent [19]

Westerman

[11] Patent Number: 5,062,527

[45] Date of Patent: Nov. 5, 1991

[54] FOLDABLE, LEAKPROOF MULTI-MODE CARTON CONSTRUCTION

[76] Inventor: Frank E. Westerman, 30 Woodberry Rd., Little Rock, Ark. 72212

[21] Appl. No.: 526,032

[22] Filed: May 21, 1990

[51] Int. Cl.[5] ..... B65D 5/36

[52] U.S. Cl. ..... 229/117; 229/117.06

[58] Field of Search ..... 229/117.06, 117

[56] References Cited

U.S. PATENT DOCUMENTS

| | | | |
|---|---|---|---|
| 3,927,824 | 12/1975 | Razziano | 229/117 |
| 4,607,786 | 8/1986 | Weaver | 229/117 |
| 4,830,271 | 5/1989 | Lau et al. | 229/117 |
| 4,895,250 | 1/1990 | Schifrin | 229/117 |

*Primary Examiner*—Joseph Man-Fu Moy

*Attorney, Agent, or Firm*—Stephen D. Carver

[57] ABSTRACT

A slotless, leakproof storage carton ideally adapted for storing medical waste and a unique blank which can be quickly folded to form the carton. Corrugated sheet stock is coated with a plastic liner and cut into blanks, which are thereafter scored. Each blank comprises a center panel, a pair of bordering width panels, a pair of bordering length panels, and four corner panels. The scoring lines comprises a first pair of spaced apart, parallel fold lines extending longitudinally, and a second pair of parallel fold lines crossing the width of the blank. Diagonal fold lines are scored into the corner panels. The center panel forms a bottom of the carton, and the width and length panels respectively form carton ends and sides. The corner panels foldably divided into separate segments which abut each other and overly the length panels. A knock down system, which permits erected cartons to be flattened, includes a knock down line which evenly bisects the blank and a cooperating pair of groups of generally triangular relief lines formed in the center panel. The assembled carton may be flattened by urging the length panels together, whereupon the width panels will fold into the carton interior. A similar deforming movement facilitated by the triangular relief lines enables the center panel to collapse outwardly from the carton. An optional, collapsible lid is preferably associated with each carton.

44 Claims, 3 Drawing Sheets

FOLDABLE, LEAKPROOF MULTI-MODE CARTON CONSTRUCTION

BACKGROUND OF THE INVENTION

The present invention relates broadly to foldable cardboard cartons and the blanks from which they are folded. More particularly the present invention relates to a multi-mode cardboard or paperboard blank which can be foldably deployed into a sealed, slotless carton adapted to safely contain contaminated medical waste products.

Awareness of the potential dangers involved in handling and disposing of contaminated materials such as medical waste products has increased. Individuals working in a medical setting are particularly sensitive to the danger of contracting life-threatening diseases such as hepatitis, AIDS, and the like through inadvertent contact with contaminated waste materials and medical products such as syringes. Stricter regulation of medical waste disposal has resulted and additional precautionary measures to prevent injury to workers are mandated. Moreover, it is well known that medical waste disposal units are frequently invaded by persons seeking used drugs or spent needles, and such persons are in serious danger of contracting and spreading undesired diseases.

In the prior art known to me, various systems have been proposed for safe disposal of contaminated waste products. U.S. Pat. No. 4,644,386 issued Feb. 16, 1988 to Padgett employs a nonwoven flexible disposal bag which can be stored flat and sealed for sterilization. An alternative embodiment teaches the use of a carton provided with an impermeable plastic seal which can be used for disposal of large objects such as animal cadavers and the like. To prevent contamination during transport, the carton must be heat-sealed or sealed with an adhesive. The earlier U.S. Pat. No. 1,176,115 issued to Way on Mar. 21, 1916 discloses a similar plastic-sealed waste disposal carton.

U.S. Pat. No. issued Jan. 21, 1969 discloses a flexible waste-receptive bag comprising an inner liner and an outer bag disposed within a rigid cylindrical outer carton. Wastes are collected in the porous inner liner, which is subsequently sealed within the liquid-impervious outer bag. The bag may be subsequently removed from or transported within the carton. U.S. Pat. No. 4,784,497 issued Nov. 15, 1988 to Dutton teaches a flat, paperboard blank which can be conveniently carried and readily assembled into a rectangular carton for disposal of small litter such as cups, cans, and tissues. Of somewhat less relevance are U.S. Pat. No. 4,801,006 issued to Martin on Jan. 31, 1989; and U.S. Pat. No. 4,724,955, issued Feb. 16, 1988 to Martin. Both of the last-mentioned references teach the use of containers for mounting a plurality of flexible litter disposal bags. When one litter bag is used, the bag is removed for disposal, and a subsequent fresh bag is exposed for immediate use.

Various bag-in-box combinations are applied in the prior art for other purposes as well. Such systems are taught by Green U.S. Pat. No. 4,660,737 issued Apr. 28, 1987; U.S. Pat. No. 4,572,422 issued Feb. 25, 1986 to Heuberger.; and, Sachs U.S. Pat. No. 3,122,297 issued Feb. 25, 1964 for storage of liquids such as milk.

It is also known in the prior art to provide a container with a leak-proof or insulating liner for storing various types of liquids. Heisler U.S. Pat. No. 3,262,628 issued July 26, 1966 discloses a carton in which a flexible molded plastic drum is locked into position for safe shipping. U.S. Pat. No. 3,927,821 issued Dec. 23, 1975 to Dunning teaches the use of a flexible plastic liner adhered to the inner walls of a cardboard carton. The liner is sealed to the carton by a vacuum heat shrink process. The laminated container taught by Bamburg, U.S. Pat. No. 3,910,482 issued Oct. 7, 1975 provides two layers of leak-proof liner which are glued together to seal overlapping seams.

Two prior art patents of particular relevance to my invention are Centanni U.S. Pat. No. 4,087,041 issued May 2, 1978 and U.S. Pat. No. 3,333,392, issued Aug. 1, 1967 to Calvert. The last-mentioned Calvert reference discloses a flexible bag which is adhered to a carton blank adapted to store liquids. The flexible bag liner is folded and inserted into the assembled rigid carton with its spout protruding through the carton. The bag is then glued or taped in position. The assembled bag and box can be readily collapsed for convenient storage and transport and reassembled for filling with a liquid such as milk.

The Centanni '041 construction comprises a seamless interior container formed from overlapping paperboard liner portions. Once the liner is constructed, it is placed within a conventional paperboard carton and glued to the inner wall. The resulting structure comprises three layers of paperboard or corrugated, and may subsequently be sealed with an appropriate lid.

One waste disposal system currently in widespread use in the field is produced by BFI, Browning Ferris. The BFI system comprises a disposal box which is prescored for convenient folding. The overlapping flaps are subsequently taped together. The carton must then be safely stored for handling by the BFI service.

Unfortunately, none of the prior art cartons known to me is ideal for the safe containment of medical wastes. Known prior art approaches fail to provide adequate liquid-tight sealing. In known prior art boxes both the liners and the outer cartons have seams or slits which must be sealed or crimped. Moreover, reassembly after shipping of the cartons is cumbersome and time-addition, consuming. For example, the carbons must be sealed with tape or adhesives after assembly from the flattened transport state. In addition, none of the prior art storage systems known to me provides adequate means for safely carrying or holding the carton during transport. Used medical syringes or the like stored in these prior art cartons could easily punch through the liners and injure the carrier.

Finally, it is well known to construct containers of styrofoam and similar insulating materials which are lightweight, inexpensive, and substantially leakproof. Styrofoam containers are quite commonly used as ice chests for temporarily storing perishable foods and cold drinks. Additionally, styrofoam has been widely used by fast food establishments for packaging hot meals and/or sandwiches. However, in view of the environmental threat posed by such materials, it is believed that their use will be severely restricted or entirely prohibited in the near future.

Thus it is desired to provide a system for safely containing and disposing of medical waste products. For greatest safety, it is desired to provide a lined carton which can be readily collapsed for transport and storage, easily reassembled for use, and which is leak-proof and puncture-proof for protection of medical staff.

Moreover, it is desired to provide a medical waste container which may be safely disposed of after use in order to prevent theft and use of contaminated medical products.

SUMMARY OF THE INVENTION

I have invented a storage carton and a unique blank which can be quickly folded to form the carton. A prime use for the carton is to store a variety of contents such as medical waste. The blank is slotless and, after proper folding, the blank forms a carton having no natural leak paths, so that the carton is an ideal storage device.

The preferably rectangular blank is ideally die-cut from corrugated sheet. It could also be formed from paperboard, solid fiber material or cardboard. Preferably the sheet stock comprises a single layer of cross-laminated, insulating plastic material, such as that currently marketed under the brand name VALERON$^{tm}$. The lined sheet is then cut into blanks through conventional die-cutting. Individual panels are defined in the blank as a result of scoring as described hereinafter.

Each blank comprises a center panel bordered by a pair of width panels and a pair of length panels. Four corner panels complete the array. A plurality of score lines defined in the blank generally border individual panels, and enable subsequent folding. Preferably a first pair of spaced apart, parallel fold lines extend longitudinally along the length of the blank, and a second pair of parallel fold lines traverse the width of the blank. Diagonal fold lines are scored into the corner panels. The center panel will form a bottom of the carton, and the width and length panels will respectively form carton ends and sides.

When the width and length panels are folded vertically upwardly, the corner panels will bend across the diagonal fold lines and deform. The corner panels will form two substantially identical, generally triangular segments, which will abut each other in surface-to-surface contact after proper folding. Each of the triangular segments will project into the carton being formed, and they will overlay each other and border the carton length panels after carton erection. The carton will thus be formed without any slots. Knock-out holes defined in various blank panels align during carton erection to form suitable handles.

Preferably a knock down system is included to enable erected cartons to be folded into a flat storage or shipping configuration. The preferred knock down system includes a knock down line which evenly bisects the blank and divides the center panel and the two width panels in half. A cooperating pair of groups of generally triangular relief lines intersected by the knock down line are defined in the top and bottom of the center panel.

The assembled carton may be flattened by urging the length panels together, whereupon the width panels will deform and fold, occupying the carton interior. A similar deforming movement facilitated by the triangular relief lines enables the center panel (which forms the floor of the carton) to deform and project outwardly from the carton, enabling the carton to assume a flat orientation. Thus, a large supply of my cartons can be stored with minimal space requirements. When the carton is to be used, it can be conveniently unfolded into a full-size carton, and deployed for immediate use without the need for additional adhesives or sealers.

A collapsible lid is preferably associated with each carton. The lid can be conveniently packaged together with the flat carton for shipping and storage. The interior edges of the lid are preferably coated with a sealing adhesive temporarily covered by a removable sealing strip. When the carton is covered, the sealing strip can be readily removed, and the lid edges pressed onto the carton for safe sealing. Thus the user's hands are safely isolated from accidental contact with the contents of the carton. Also, the need for applying tapes or other sealers is obviated. The sealed carton is highly resistant to undesired insect invasion after disposal, and it is difficult for drug addicts or scavengers to open.

Thus a broad object of my invention is to provide a slotless carton for safely containing a variety of items.

A related basic object is to provide an inexpensive blank which easily folds into a slotless storage carton.

Another object of the present invention is to provide a slotless, foldable carton characterized by enhanced leak resistance.

A related object of the present invention is to provide a medical waste container.

A still further object is to provide a container of the character described which may be formed simply by folding a blank, but which may be easily flattened into a transportable or storage position after erection.

Another fundamental object of the present invention is to provide a carton for safely storing a variety of items without leakage.

A further basic object of the present invention is to provide a container which can be safely used for disposal of contaminated medical waste products.

Another object is to provide a thermally insulated container which may be used in lieu of conventional styrofoam containers.

A still further object is to provide a container of the character described which may be safely sealed against undesired invasion from insects and the like.

Another object of the present invention is to provide a foldable waste disposal box which, when used to store a conventional flexible waste bag, fortifies and seals it.

An additional object of the present invention is to provide a lined and insulated waste disposal box of the character described which may be readily assembled from a single pre-scored carton blank.

Yet another object of the present invention is to provide a medical waste disposal system which is highly resistant to puncture from syringes and the like.

A further object of the present invention is to provide a waste disposal system of the character described which combines a flexible disposal bag with a lined, leakproof storage carton, and an outer, sealed carton for enhanced safety.

Still another object of the present invention is to provide a waste disposal container which is constructed of materials which can be legally incinerated.

Yet another object is to provide a foldable carton which is effective for storing warm or cold products for extended periods.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
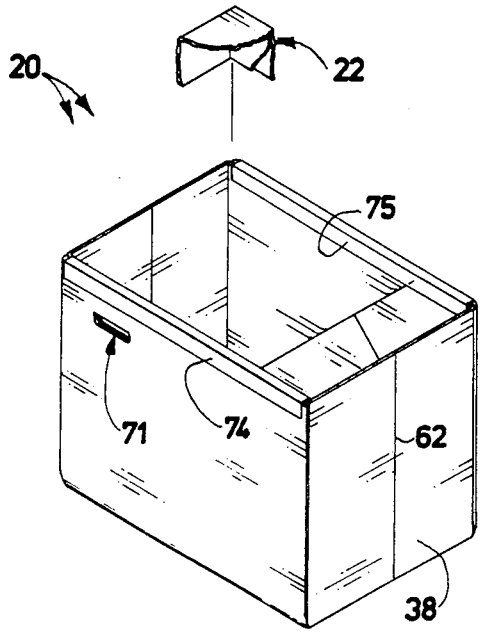
FIG. 1 is a fragmentary perspective view of the best mode of my foldable, leakproof slotless carton with the optional liner included, and the optional lid removed.
Figure 2:
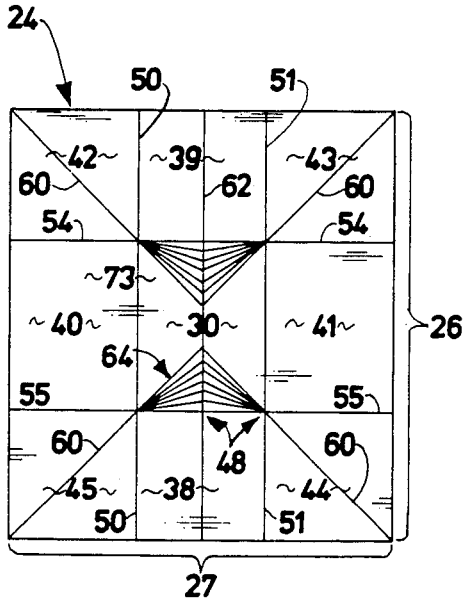
FIG. 2 is a top plan view of the pre-scored carton blank, with the liner omitted.

With initial reference now directed to FIGS. 1–4 of the appended drawings, my slotless carton has been generally designated by the reference numeral 20. While the carton is ideally adapted to hold offensive, partially liquid contents such as medical wastes and the like, the carton may be used for a variety of other items. My unique blank 24 can be folded to make carton 20. When folded as hereinafter described, blank 24 forms carton 20 in such a manner that no slots are formed, and no natural leak path exists. After erection the carton may be flattened for storage or shipping as hereinafter described. Carton 20 preferably is associated with a removable lid 22 to be described later, which can be sealed to the carton top.

Preferably blank 24 is formed from a die-cut piece of corrugated sheet material. It can also be formed from paperboard, cardboard, or other fibrous sheet materials known in the art. As viewed in FIG. 2 it is preferably somewhat rectangular, having a length 26 somewhat greater than its width 27. The panel has been appropriately scored by a plurality of score lines to be later described which divide the blank into a plurality of separate but integral panels. When blank 24 is folded to form the carton 20, each of the panels seen in FIG. 2 will form the various body portions of the carton in FIG. 1. The blank surface projecting toward the viewer in FIG. 2 becomes the interior surface of the carton 20 after folding.

Figure 10:
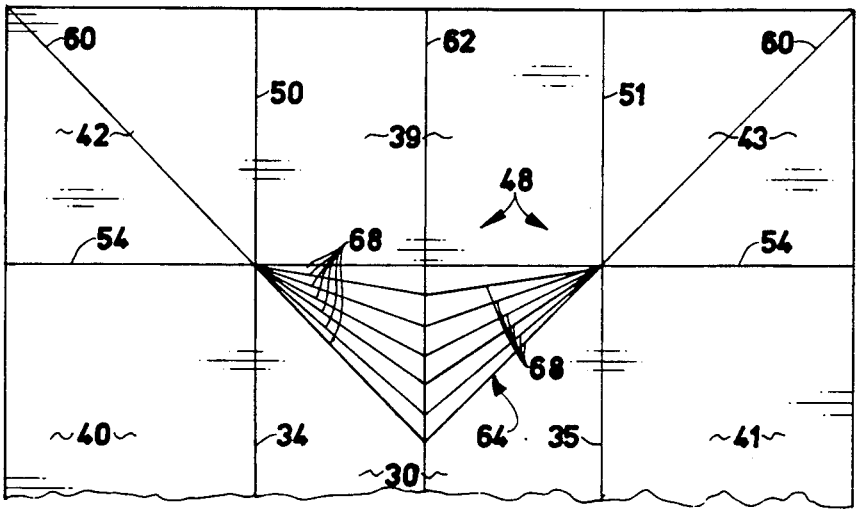
FIG. 10 is an enlarged, fragmentary plan view of the blank of FIG. 2 showing portions of the scoring system and the knock down line system in detail.

With additional reference to FIG. 10, blank 24 comprises a generally rectangular center panel 30 comprising a top 31, a bottom 32 and a pair of spaced apart sides 34, 35. The center panel 30 will form the floor of the carton 20 after folding. Integral width panels 38 and 39 border the center panel 30 at its top and its bottom. They are integral with a pair of length panels 40, 41 which adjoin the center panel at its sides 34, 35. Finally, the blank 24 is also divided into four separate corner panels 42 through 45, which fold out of the way into the interior of carton 20. Corner panels 42–45 border the various length and width panels. Corner panel 43, for example, adjoins length panel 41 and width panel 39. The corner panels will bend as hereinafter described and deform interiorly of the carton so as to dispose themselves adjacent the length panels, and no slots in the carton will be needed.

To enable folding a score line system broadly designated by the reference numeral 48 has been employed. Individual score lines are defined in the blank to facilitate folding. The score line system comprises a first pair of spaced apart generally parallel fold lines 50, 51 which run the length of the blank 24 and which divide the center panel 30 from each length panel 40, 41. The scoring system 48 preferably comprises a second pair of spaced apart, generally parallel fold lines 54, 55 which extend generally horizontally (as viewed in FIG. 2) and which divide the center panel from the width panels 38, 39. It will be apparent that the second pair of fold lines 54, 55 are generally parallel with one another, and they are generally perpendicular to and intersect the first pair of fold lines 50, 51. Substantially symmetry is preserved. Further, it will be apparent that the corner panels are defined between intersecting fold lines from the first and second pairs discussed. Corner panel 42, for example, is defined between fold lines 50 and 54.

System 48 also comprises four diagonal fold lines which bisect each corner panel and extend partially into the center panel 30. For example, corner panel 42 is bisected by the diagonal fold line 60 which extends diagonally across corner panel 42 and bisects it into two similarly shaped triangular segments 42A, 42B. Each of the other corner panels are similarly divided into triangular segments by their diagonal fold lines 60. Through this construction the corner panels are assimilated within the interior of the carton during folding adjacent the length panels.

Figure 5:
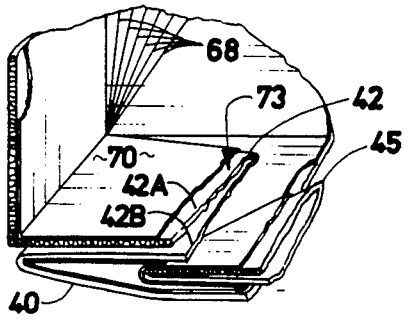
FIG. 5 is an enlarged, fragmentary top plan view of the corner portion of the assembled carton, with the liner included.
Figure 8:
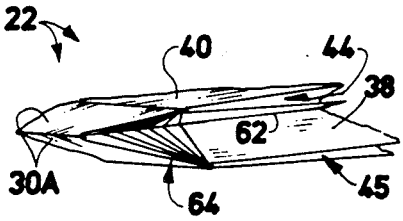
FIG. 8 is a fragmentary, pictorial view illustrating the outwardly projecting bottom panel when the carton is substantially collapsed.

Blank 24 is also provided with a knock down system which enables it to be flattened. The sides of the carton need merely be manually compressed together as in FIGS. 6–8 to flatten the carton for efficient storage or transportation. The knock down system comprise a first knock down line 62 which longitudinally extends across blank 24 in the center thereof, dividing it into two rectangles. It divides each width panel in half, and bisects the center panel 30. The knock down system also comprises a second knock down line means generally designated by the reference numeral 64, which comprises two groups of generally triangular shaped relief lines 68 (FIG. 5). It will be noted that the outermost line of the triangular relief lines actually comprise an extension of the diagonal score line 60. The inner lines 68 forms smaller and smaller triangles towards the fold lines 54, 55. By relieving the blank in this manner the center panel 30 may be deformed and pushed outwardly and the assembled carton will flatten across knock down line 62. With reference to FIG. 8, it will be noted that the underside 30A of center panel 30 projects away from the bottom of the carton.

Figure 3:
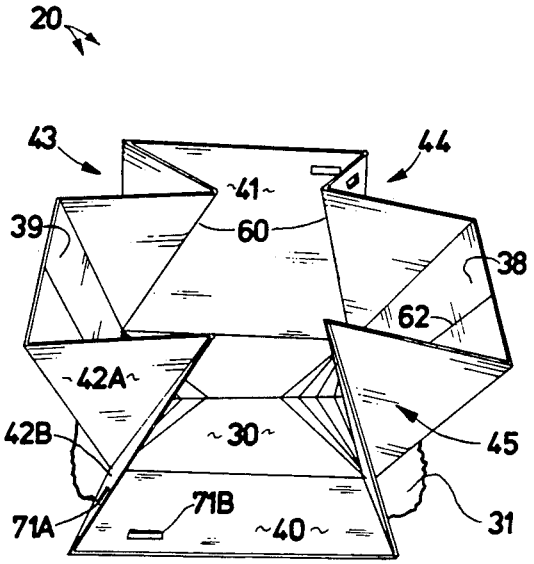
FIG. 3 is a perspective view illustrating the carton blank of FIG. 2 disposed in a partially folded configuration.

With reference now directed to FIGS. 1 through 4, carton 20 is formed by grasping either the width panels or length panels and bending them upwardly relative to the center panel. They will move until disposed substantially vertically relative to the center panel 30, which forms a carton floor. In FIG. 3 center panel 30 is disposed on supporting surface 31 and the width panels 38 and 39 have been moved vertically upwardly, and folded over lines 54, 55. At this time the length panels 40, 41 may be folded upwardly as well, so that they will eventually be perpendicular to the center panel 30. However, as this occurs, each of the corner panels 42 through 45 deforms into two similarly shaped triangular segments, across the fold lines 60 previously described. Each corner panel will deform and project interiorly of the carton.

Figure 9:
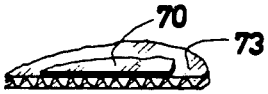
FIG. 9 is an enlarged, fragmentary, sectional view through a piece of the blank showing the optional plastic liner.

As folding continues, the corner panels' triangular halves will be compressed together. As folding progresses from FIG. 3 to FIG. 5 for example, the triangular segments 42A, 42B, of corner panel 42 will be compressed together. This pair of corner panel triangular segments will overlay the other corner panel, as shown in FIG. 5, wherein it will be noted that corner panel 42 is thus folded into abutment with corner panel 45. The triangular segments overlay one another, and they abut the length panel 40. The opposite carton side is formed in the same fashion. Because the corner panels yieldably deflect into the carton interior, no slots are needed. After the carton is folded as described, it will take on the configuration substantially shown in FIG. 1.

Where the carton is to be used for containing products which are at least partially liquid, it is preferred that each blank include a resilient plastic liner formed of Valeron TM brand plastic. The liner is disposed over the surface shown in FIG. 2, which will become the carton interior surface after folding. The liner 70 will be adhesively adhered to the inner face of body 73 (FIG. 9). It is preferred in manufacture to secure the liner upon sheet stock prior to die cutting. When folded into the position of FIG. 1, it is preferred that a pair of length panel rails 74, 75 be taped onto the upper length panels. This will maintain the corner panel triangular segments in proper alignment.

Figure 4:
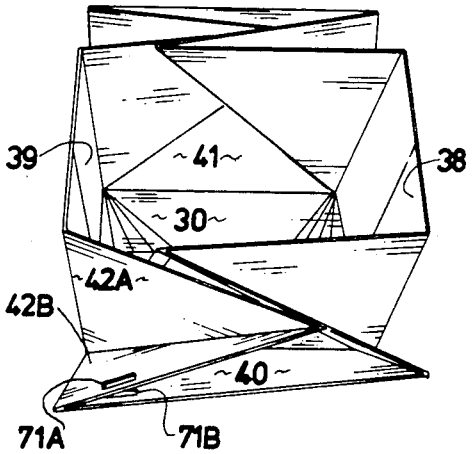
FIG. 4 is a perspective view similar to FIG. 3, but illustrating the blank in a more fully folded configuration.
Figure 6:
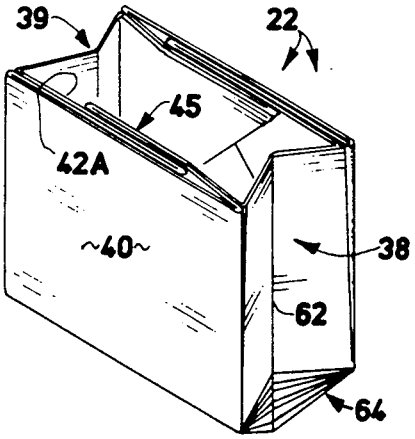
FIG. 6 is an isometric view illustrating the assembled carton in a partially collapsed configuration prior to total knock down, with the liner omitted.
Figure 7:
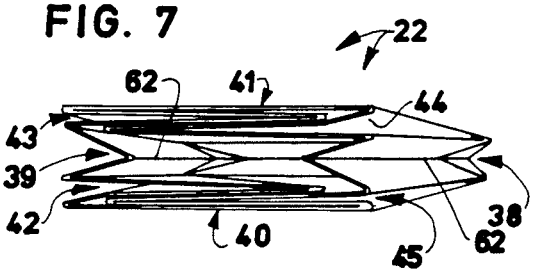
FIG. 7 is an isometric view looking into the interior of the carton, with the carton substantially collapsed and the liner omitted.

Turning now to FIGS. 6 through 8, once the carton 20 is erected as shown in FIG. 1, it can be manipulated via handles 71 formed from appropriately located knock outs in the various panels. It will be noted in FIG. 4 that knock-out 71A is formed in corner panel segment 42B, and knock out 71B is appropriately formed in length panel 40. When folding occurs, each knock out registers, and when aligned they form handle 71. The handle does not extend all the way through the box; ingress is blocked through corner panel segment 42A (FIG. 4).

After erection, the carton may be folded into a flat storage configuration for storage or shipping. To accomplish this, the width panels 38 and 39 are pushed towards each other, deforming as seen in FIG. 5. Folding in this fashion is enabled by the knock down system previously described, consisting of the first knock down line 62 which is defined in each of the width panels, and the groups of triangular knock down lines 68 previously discussed. When the width panels are folded towards each other as shown in FIG. 5, they will compress internally of the carton, forming the configuration shown in FIG. 7. As collapsing continues, the knock down lines 68 enable the center panel 30 to deform and project downwardly from its normal position. In other words, it projects away from the carton floor (i.e. the center panel 30), forming the somewhat pointed projection of FIG. 8.

Figure 11:
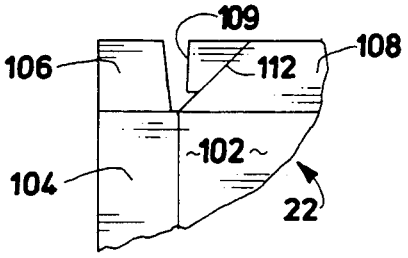
FIG. 11 is a fragmentary plan view of a corner portion of the optional lid.
Figure 12:
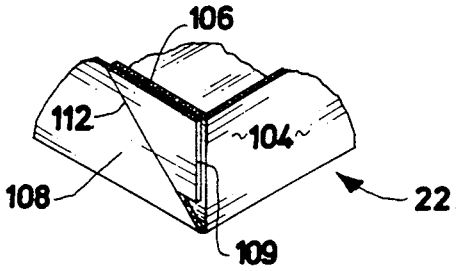
FIG. 12 is a fragmentary pictorial view of the assembled corner portion of the optional lid; and, FIG. 13 is a fragmentary perspective view of a corner portion of the collapsed lid.
Figure 13:
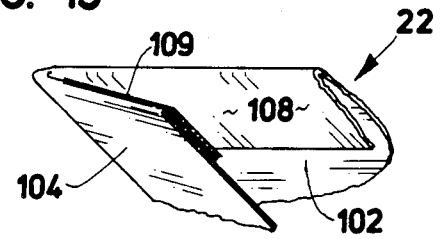

With reference now to FIGS. 11–13, an optional lid 22 is formed from a conventional slotted blank having a rectangular center piece 102, an end 104 having a flap 106 and a top fold 108 having a notched edge 109. In construction the flap 106 is bent inwardly and edge 108 will be glued to it as shown in FIG. 12. Flap 108 has a score line 112 defined diagonally relative to notched edges 109, which enables the top to be flattened for storage.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A blank adapted to be folded into a slotless carton without natural leak paths for safely containing contents such as medical waste, said blank comprising:

center panel means for integrally forming a continuous, slotless floor of said carton, said center panel means comprising a top, a bottom, and a pair of spaced apart sides;

width panel means integral with said center panel means for forming end walls of said carton, said width panel means adjoining said center panel means at said top and said bottom;

length panel means integral with said center panel means and said width panel means for forming side walls of said carton, said length panel means adjoining said center panel means at said sides;

corner panel means for yieldably bending into said carton interior when said blank is folded into said carton, said corner panel means integral with said center panel means, said width panel means, and said length panel means; and score line means for facilitating folding of said width panel means, said length panel means, and said corner panel means, thereby enabling the formation of said carton.

2. The blank as defined in claim 1 wherein said blank comprises a predetermined length and width, and said score line means comprises:

a first pair of spaced apart, generally parallel fold lines running the length of said blank and separating said center panel means from said length panel means; and, a second pair of spaced apart, generally parallel fold lines generally perpendicular to and intersecting said first pair of fold lines, said second pair of fold lines running the width of said blank and separating said center panel means from said width panel means.

3. The blank as defined in claim 2 wherein said corner panel means is bounded by one of said first pair of fold lines and one of said second pair of fold lines.

4. The blank as defined in claim 2 wherein said score line means comprises a diagonal fold line extending diagonally across said corner panel means to said center panel means for enabling said corner panel means to divide into two separate segments when said blank is folded.

5. The blank as defined in claim 4 wherein said corner panel means folds into two similarly shaped triangular segments folded across said diagonal fold line when said blank is folded to form said carton.

6. The blank as defined in claim 5 wherein said corner panel means segments make surface-to-surface contact with one another when said blank is folded to form said carton.

7. The blank as defined in claim 5 wherein said corner panel means segments are folded into contact with said length panel means when said blank is folded to form said carton.

8. The blank as defined in claim 1 wherein said blank comprises knock-down means for facilitating the quick collapse of said carton into a flattened configuration for convenient transport and storage.

9. The blank as defined in claim 8 wherein said knock down means comprises first knock down line means generally bisecting said blank, and cooperating second knock down line means formed in said center panel means top and bottom.

10. The blank as defined in claim 9 wherein said first knock down line means extends across said width panel means and said center panel means and is disposed generally parallel with and between said first pair of fold lines.

11. The blank as defined in claim 9 wherein said second knock down line means comprises a pair of groups of generally triangular shaped relief lines intersecting said first knock down line means within said center panel means, one group formed in the center panel means top and the other group formed in the center panel means bottom.

12. The blank as defined in claim 9 wherein:

said corner panel means is bounded by one of said first pair of fold lines and one of said second pair of fold lines; and, said score line means comprises a diagonal fold line extending diagonally across said corner panel means to said center panel means for enabling said corner panel means to divide into two separate segments when said blank is folded to form said carton.

13. The blank as defined in claim 1 including liner means of plastic material for further leak proofing said carton.

14. A leak-proof, slotless carton for safely containing contents such as medical waste, said carton comprising:

a blank adapted to be folded to form said carton, said blank having an inner surface, an outer surface, and a predetermined length and width, said blank comprising:

center panel means for integrally forming a continuous, slotless floor of said carton, said center panel means comprising a top, a bottom, and a pair of spaced apart sides;

width panel means integral with said center panel means for forming end walls of said carton, said width panel means adjoining said center panel means at said top and said bottom;

length panel means integral with said center panel means and said width panel means for forming side walls of said carton, said length panel means adjoining said center panel means at said sides;

corner panel means bordered by said width panel means and said length panel means for yieldably bending into said carton interior when said blank is folded, said corner panel means integral with said center panel means, said width panel means, and said length panel means;

score line means defined in said blank for facilitating folding of said width panel means, said length panel means, and said corner panel means, thereby enabling the formation of said carton; and, unitary liner means permanently adhered to said inner face for insulating said carton;

knock-down means defined in said blank for facilitating the quick collapse of said carton into a flattened configuration for convenient transport and storage; and, lid means for selectively sealing said carton.

15. The carton as defined in claim 14 wherein said liner means comprises a unitary sheet of non-woven, cross-laminated plastic material, whereby said carton is virtually leak-proof and puncture-proof.

16. The carton as defined in claim 14 wherein said score line means comprises:

a first pair of spaced apart, generally parallel fold lines running the length of said blank and separating said center panel means from said length panel means; and, a second pair of spaced apart, generally parallel fold lines generally perpendicular to and intersecting said first pair of fold lines, said second pair of fold lines running the width of said blank and separating said center panel means from said width panel means.

17. The carton as defined in claim 16 wherein said corner panel means is bounded by one of said first pair of fold lines and one of said second pair of fold lines.

18. The carton as defined in claim 17 wherein said score line means comprises a diagonal fold line extending diagonally across said corner panel means to said center panel means for enabling said corner panel means to divide into two separate segments when said blank is folded to form said carton.

19. The carton as defined in claim 18 wherein said corner panel means folds into two similarly shaped triangular segments folded across said diagonal fold line when said blank is folded to form said carton.

20. The carton as defined in claim 19 wherein said corner panel means triangular segments make surface-to-surface contact with one another when said blank is folded to form said carton.

21. The carton as defined in claim 20 wherein said corner panel means segments are folded into contact with said length panel means when said blank is folded to form said carton.

22. The carton as defined in claim 16 wherein said knock down means comprises first knock down line means generally bisecting said blank, and cooperating second knock down line means formed in said center panel means.

23. The carton as defined in claim 22 wherein:

said first knock down line means extends across said width panel means and said center panel means and is disposed generally parallel with and between said first pair of fold lines; and, said second knock down line means comprises a pair of groups of generally triangular shaped relief lines intersecting said first knock down line means within said center panel means, one group formed in the center panel means top and the other group formed in the center panel means bottom.

24. The carton as defined in claim 23 including plastic liner means for further leak proofing said carton.

25. The carton as defined in claim 15 wherein said lid comprises a sealing rim comprising a strip of adhesive for conveniently sealing said lid to said carton.

26. A leak-proof, slotless carton for safely containing contents such as medical waste, said carton comprising:

a generally rectangular, flat die cut blank adapted to be folded to form said carton, said blank comprising:

a predetermined width and a predetermined length greater than said width;

an inner surface bounding the carton interior and an outer surface forming the carton exterior;

a center panel integrally forming a continuous, slotless floor of said carton, said center panel comprising a top, a bottom, and a pair of spaced apart sides;

a pair of spaced apart width panels integral with said center panel for forming end walls of said carton, said width panels adjoining said center panel at said top and said bottom;

a pair of length panels integral with said center panel and said width panels for forming side walls of said carton, said length panels adjoining said center panel at its sides;

four corner panels for yieldably bending into said carton interior when said blank is folded, said corner panels integral with said center panel, said width panels, and said length panels;

score line means defined in said blank for facilitating folding thereby enabling the formation of said carton; and, knock-down means defined in said blank for facilitating the quick collapse of said carton into a flattened configuration for convenient storage and transportation after said carton has been deployed.

27. The carton as defined in claim 26 wherein said knockdown means comprises a knockdown line extending the length of said blank and a cooperating pair of groups of generally triangular shaped relief lines intersecting said first knock down line within said center panel, one group formed in the center panel top and the other group formed in the center panel bottom.

28. The carton as defined in claim 27 wherein said score line means comprises:

a first pair of spaced apart, generally parallel fold lines running the length of said blank and separating said center panel from said length panels;

a second pair of spaced apart, generally parallel fold lines generally perpendicular to and intersecting said first pair of fold lines, said second pair of fold lines running the width of said blank and separating said center panel from said width panels; and, a diagonal fold line extending diagonally across said corner panel to said center panel for enabling said corner panel to divide into two separate segments when said blank is folded to form said carton.

29. The carton as defined in claim 28 wherein said corner panels folds into two similarly shaped triangular segments folded across said diagonal fold line when said blank is folded to form said carton.

30. The carton as defined in claim 29 wherein said corner panel triangular segments make surface-to-surface contact with one another when said blank is folded to form said carton.

31. The carton as defined in claim 30 wherein said corner panel segments are folded into contact with said length panel when said blank is folded to form said carton.

32. The carton as defined in claim 30 including non-woven, laminated plastic liner for leak proofing said carton.

33. The carton as defined in claim 30 including a lid comprising a sealing rim comprising a strip of adhesive for conveniently sealing said lid to said carton.

34. A blank for forming a slotless carton without producing leak paths, said blank comprising:

center panel means for forming a continuous, integral, slotless floor of said carton;

width panel means integral with said center panel means and adapted to be folded perpendicularly relative to said center panel means for forming slotless end walls of said carton;

length panel means integral with said center panel means and adapted to be folded perpendicularly relative to said center panel means for forming slotless side walls of said carton; and, means for yieldably bending into said carton interior when said width panel means and said length panel means are folded, said last mentioned means integral with said center panel means, said width panel means, and said length panel means.

35. The blank as defined in claim 34 wherein:

said blank comprises score line means for facilitating folding of said blank to form said carton;

said center panel means comprises a top, a bottom, and a pair of spaced apart sides;

said width panel means adjoins said center panel means at said top and said bottom; and, said length panel means adjoins said center panel means at said sides.

36. The blank as defined in claim 35 further comprising knock-down means integral with said center panel means for facilitating the quick collapse of said carton into a flattened configuration for convenient transport and storage, and said knock down means comprising first knock down line means generally bisecting said blank and cooperating second knock down line means formed in said center panel means.

37. The blank as defined in claim 35 wherein said score line means comprises:

a first pair of spaced apart, generally parallel fold lines running the length of said blank and dividing said center panel means from said length panel means; and, a second pair of spaced apart, generally parallel fold line generally perpendicular to and intersecting said first pair of fold lines, said second pair of fold lines running the width of said blank and dividing said center panel means from said width panel means.

38. The blank as defined in claim 37 wherein said means for yieldably bending into said carton comprises corner panel means integral with said center panel means, said length panel means and said width panel means, said corner panel means bounded by one of said first pair of fold lines and one of said second pair of fold lines.

39. The blank as defined in claim 38 wherein said score line means comprises a diagonal fold line extending diagonally across said corner panel means to said center panel means for enabling said corner panel means to divide into two separate segments when said blank is folded to form said carton.

40. The blank as defined in claim 39 wherein said corner panel means folds into two similarly shaped triangular segments folded across said diagonal fold line when said blank is folded to form said carton, and wherein said corner panel means triangular segments make surface-to-surface contact with one another when said blank is folded to form said carton.

41. The blank as defined in claim 40 further comprising knock-down means integral with said center panel means for facilitating the quick collapse of said carton into a flattened configuration for convenient transport and storage, and said knock down means comprises first knock down line means generally bisecting said blank and cooperating second knock down line means formed in said center panel means.

42. The blank as defined in claim 41 wherein:

said first knock down line means extends across said center panel means and is disposed generally parallel with and between said first pair of fold lines; and, said second knock down line means comprises a pair of groups of generally triangular shaped relief lines intersecting said first knock down line means within said center panel means, one group formed in the center panel means top and the other group formed in the center panel means bottom.

43. The blank as defined in claim 42 further comprising unitary liner means permanently adhered to said center panel for insulating said carton.

44. The blank as defined in claim 43 wherein said liner means comprises a unitary sheet of non-woven, cross-laminated plastic material, whereby said carton is virtually leak-proof and puncture-proof.

* * * * *